US007309848B2

(12) United States Patent
Takamura et al.

(10) Patent No.: US 7,309,848 B2
(45) Date of Patent: Dec. 18, 2007

(54) SEALING STRUCTURE OF CERAMIC HEATER

(75) Inventors: Kozo Takamura, Nagoya (JP); Makoto Shirai, Hekinan (JP); Kenji Fukaya, Chiryu (JP)

(73) Assignee: Denso Corporation, Kariya, Aichi-Pref. (JP)

( * ) Notice: Subject to any disclaimer, the term of this patent is extended or adjusted under 35 U.S.C. 154(b) by 0 days.

(21) Appl. No.: 11/185,010

(22) Filed: Jul. 20, 2005

(65) Prior Publication Data

US 2006/0016802 A1 Jan. 26, 2006

(30) Foreign Application Priority Data

Jul. 20, 2004 (JP) ..... 2004-211818
Jan. 14, 2005 (JP) ..... 2005-007456

(51) Int. Cl.
*H05B 3/44* (2006.01)

(52) U.S. Cl. ..... 219/544

(58) Field of Classification Search ..... 219/544, 219/542, 536; 435/807; *H05B 3/44*
See application file for complete search history.

(56) References Cited

U.S. PATENT DOCUMENTS 3,629,554 A * 12/1971 Stewart ..... 219/522
4,035,613 A * 7/1977 Sagawa et al. ..... 219/552
4,100,398 A * 7/1978 Levin ..... 219/541
4,410,874 A * 10/1983 Scapple et al. ..... 338/307
5,228,975 A * 7/1993 Yamada et al. ..... 204/424
6,118,110 A 9/2000 Kobayashi et al.
6,121,590 A 9/2000 Kobayashi et al.
6,130,410 A * 10/2000 Kita ..... 219/270

FOREIGN PATENT DOCUMENTS

JP 11-292649 10/1999

* cited by examiner

*Primary Examiner*—Daniel Robinson
(74) *Attorney, Agent, or Firm*—Nixon & Vanderhye PC

(57) ABSTRACT

A ceramic heater is provided which may be built in a gas sensor to heat a sensor element up to a desired activation temperature. The ceramic heater includes a pair of electrical conductors formed on a ceramic body. Each of the conductors is equipped with a terminal. Leads are joined to the terminals for supplying electrical power to the conductors. Joints between the leads and the terminals are covered hermetically by a seal, thereby minimizing corrosion thereof to avoid disconnections of the terminals from the leads. This improves the durability of the ceramic heater.

9 Claims, 9 Drawing Sheets

SEALING STRUCTURE OF CERAMIC HEATER

CROSS REFERENCE TO RELATED DOCUMENT

The present application claims the benefit of Japanese Patent Application No. 2004-211818 filed on Jul. 20, 2004 and Japanese Patent Application No. 2005-7456 filed on Jan. 14, 2005, the disclosures of which are incorporated herein by reference.

BACKGROUND OF THE INVENTION

1. Technical Field of the Invention

The present invention relates generally to an improved sealing of a ceramic heater designed to be built in a gas sensor which may work to measure the concentration of a given component of exhaust emissions from an automotive engine.

2. Background Art

FIG. 7 shows a typical example of a gas sensor designed to measure the concentration of one of exhaust emissions from automotive engines.

The gas sensor 60 has installed therein a ceramic heater 9 for heating a sensor element 65 up to a desired activation temperature. The ceramic heater 9, as illustrated in FIGS. 8 and 9, consists of a ceramic heater body 92, a pair of conductors 93 formed on and in the heater body 92 in a given pattern, and leads 941. The conductors 93 are equipped with terminals 931. The leads 941 are joined to the terminals 931 through brazing metals 91, respectively, for supplying electrical power to the conductors 93. For example, Japanese Patent Fist Publication No. 11-292649 (U.S. Pat. Nos. 6,118,110 and 6,121,590) discloses such a type of ceramic heater.

Referring back to FIG. 7, the gas sensor 60 also includes a hollow cylindrical housing 68 which retains the sensor element 65 therein. The ceramic heater 9 is disposed inside the sensor element 65. The sensor element 65 is exposed at an outer surface of a top end thereof to a gas chamber 610 into which the exhaust gasses are admitted and at an inner surface thereof to an air chamber 620 into which the atmospheric air is admitted. The ceramic heater 9 is exposed at the terminals 931 to the air chamber 620. A sealant 631 is disposed between the sensor element 65 and the housing 68 to ensure an air-tight seal therebetween in order to avoid leakage of the exhaust gasses into the air chamber 620.

However, in recent years, the temperature of exhaust gas of automotive engines has been increased in order to meet tightened legal requirements of emission control, thus resulting in increased thermal loads on the sealant 631 of the ceramic heater 9, which gives rise to a degrease in degree of air-tightness between the housing 65 and the sensor element 65. This causes the exhaust gasses to leak into the air chamber 620 so that corrosion-causing substances, such as nitrogen oxides, contained in the exhaust gasses reach the terminals 931 of the ceramic heater 9. Additionally, moisture contained in the exhaust gasses may be adhered to the ceramic heater 9 or condensed during stop of the engine, thereby resulting in corrosion of the joints 913 of the terminals 931 and the leads 941 and, in the worst case, disconnections therebetween.

SUMMARY OF THE INVENTION

It is therefore a principal object of the invention to avoid the disadvantages of the prior art.

It is another object of the invention to provide an improved sealing structure of a ceramic heater designed to ensure the durability thereof.

According to one aspect of the invention, there is provided a ceramic heater which may be used in heating a sensor element of a gas sensor to a desired activation temperature. The ceramic heater comprises: (a) a ceramic body; (b) a pair of electrical conductors formed on the ceramic body, each of the conductors is equipped with a terminal; (c) leads joined to the terminals of the conductors for supplying electrical power to the conductors; and (d) a seal covering joints between the leads and the terminals of the conductors hermetically. Use of the seal avoids direct contact with the joints of the leads and the terminals with corrosion-causing substances or moisture contained in gassed to be measured by the gas sensor and also avoids the formation of electrolytes resulting from adhesion of corrosion-causing matters to the joints during production of the ceramic heater. This avoids the corrosion of the joints and, in the worst case, physical separation of the leads from the terminals.

In the preferred mode of the invention, the seal covers a whole of the terminals of the conductors to enhance the avoidance of corrosion of the joints.

The seal may be made of glass in order to offer the resistance to high temperatures in a case where the gas sensor is high in an operating temperature thereof or used in high temperature environments. The glass may be either crystallized or uncrystallized. The seal may alternatively be made of resin in a case where the gas sensor is lower in the operating temperature.

The seal has preferably a coefficient of thermal expansion within a range of $\pm 15\times 10^{-7}/°$ C. and more preferably of $\pm 10\times 10^{-7}/°$ C. of that of the heater body in order to reduce a difference in thermal expansion between the heater body and the seal during usage of the ceramic heater to avoid cracks in the seal.

For example, when the heater body is made of alumina ($Al_2O_3$) and has a coefficient of thermal expansion of $60\times 10^{-7}/°$ C., the seal preferably has a coefficient of thermal expansion of $45\text{-}75\times 10^{-7}/°$ C. and more preferably $50\text{-}70\times 10^{-7}/°$ C. Alternatively, when the heater body is made of silicon nitride ($Si_3N_4$) and has a coefficient of thermal expansion of $25\times 10^{-7}/°$ C., the seal preferably has a coefficient of thermal expansion of $10\text{-}40\times 10^{-7}/°$ C. and more preferably $15\text{-}35\times 10^{-7}/°$ C.

The seal may have a glass transition temperature of 400° C. or more and a welding temperature of 900° C. or less, thereby ensuring the durability thereof and air- and liquid-tight sealing of the joints of the terminals and the leads without any adverse impact thereon. Specifically, a maximum operating temperature of the gas sensor is usually 400° C. Therefore, as long as the glass transition temperature of the seal 5 is 400° C. or more, it will keep the seal solid during usage of the gas sensor. When the welding temperature of the seal is more than 900° C., it may cause the joints between the terminals and the leads to be fused and also result in a decrease in joint strength between the terminals and the heater body.

The seal has preferably a coefficient of thermal expansion within a range of $\pm 15\times 10^{-7}/°$ C. and more preferably $\pm 10\times 10^{-7}/°$ C. of that of the leads, thereby reducing a difference in thermal expansion between the leads and the seal during usage of the gas sensor to avoid cracks in the seal.

The leads may be made of one of 42 alloy and kovar. In this case, the coefficient of thermal expansion of the leads may be approximated to that of the seal in order to reduce a difference in thermal expansion between the leads and the seal during usage of the ceramic heater to minimize cracks in an interface of the seal with the leads.

The ceramic heater may further include a holder which retains therein the seal to keep a configuration thereof in a desired shape. The holder may be made of alumina or mullite.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
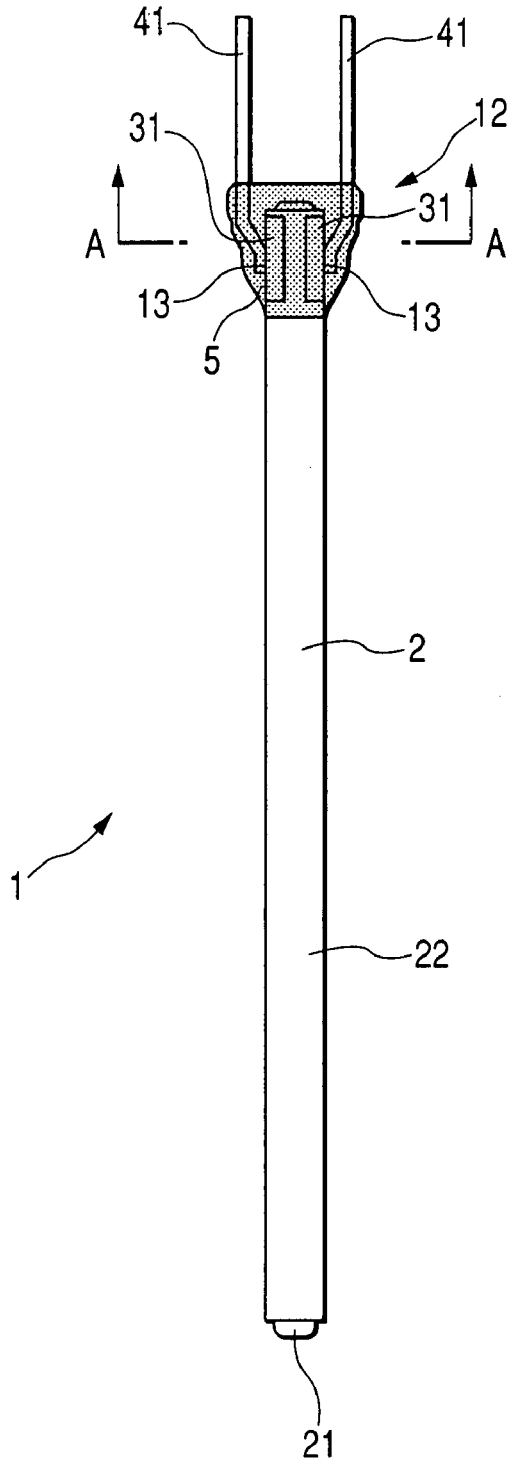
FIG. 1 is a plan view which shows a ceramic heater according to the first embodiment of the invention.
Figure 2:
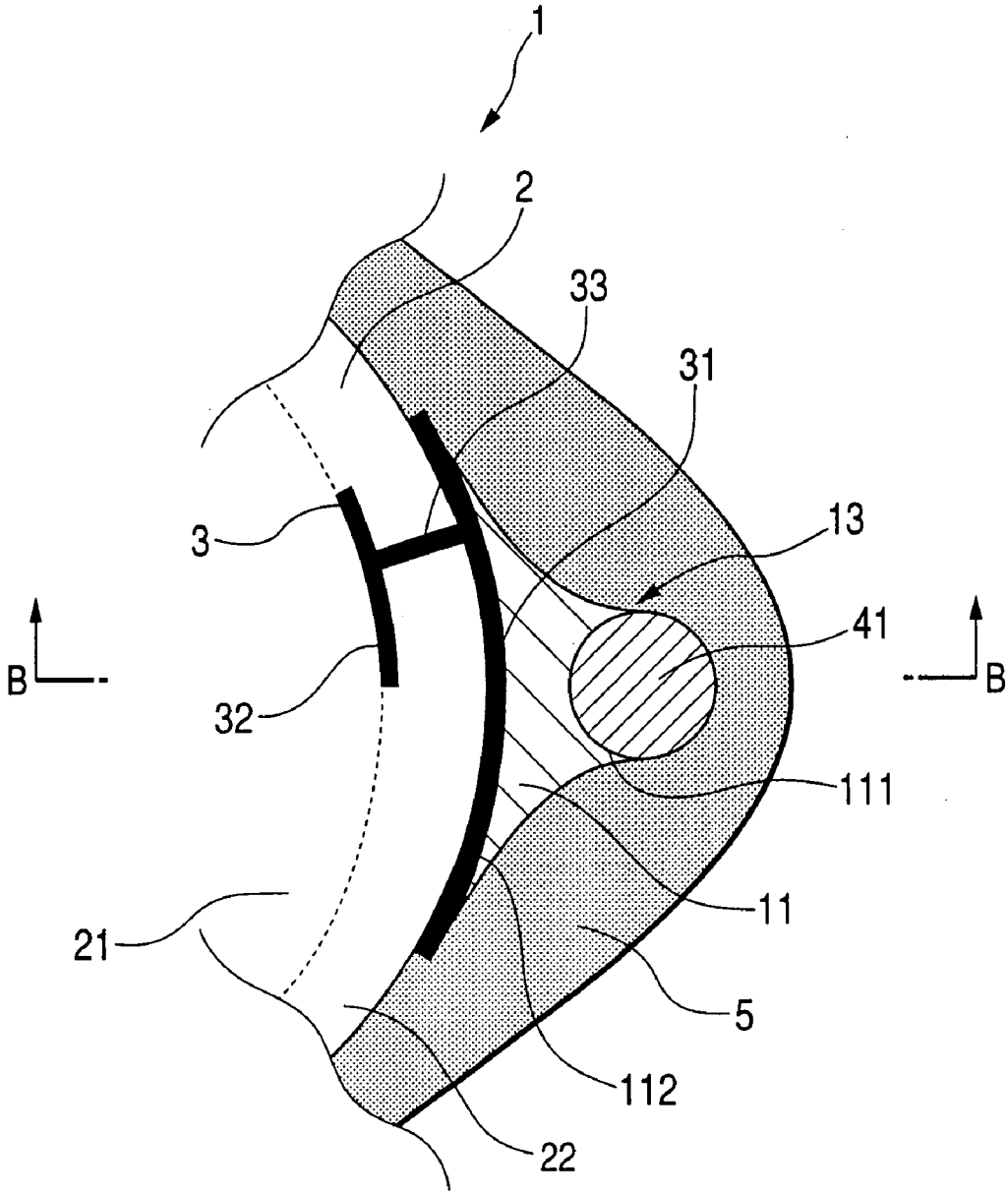
FIG. 2 is a partially traverse sectional view, as taken along the line A-A in FIG. 1, which shows a sealing structure of joints between leads and terminals of the ceramic heater of FIG. 1.
Figure 3:
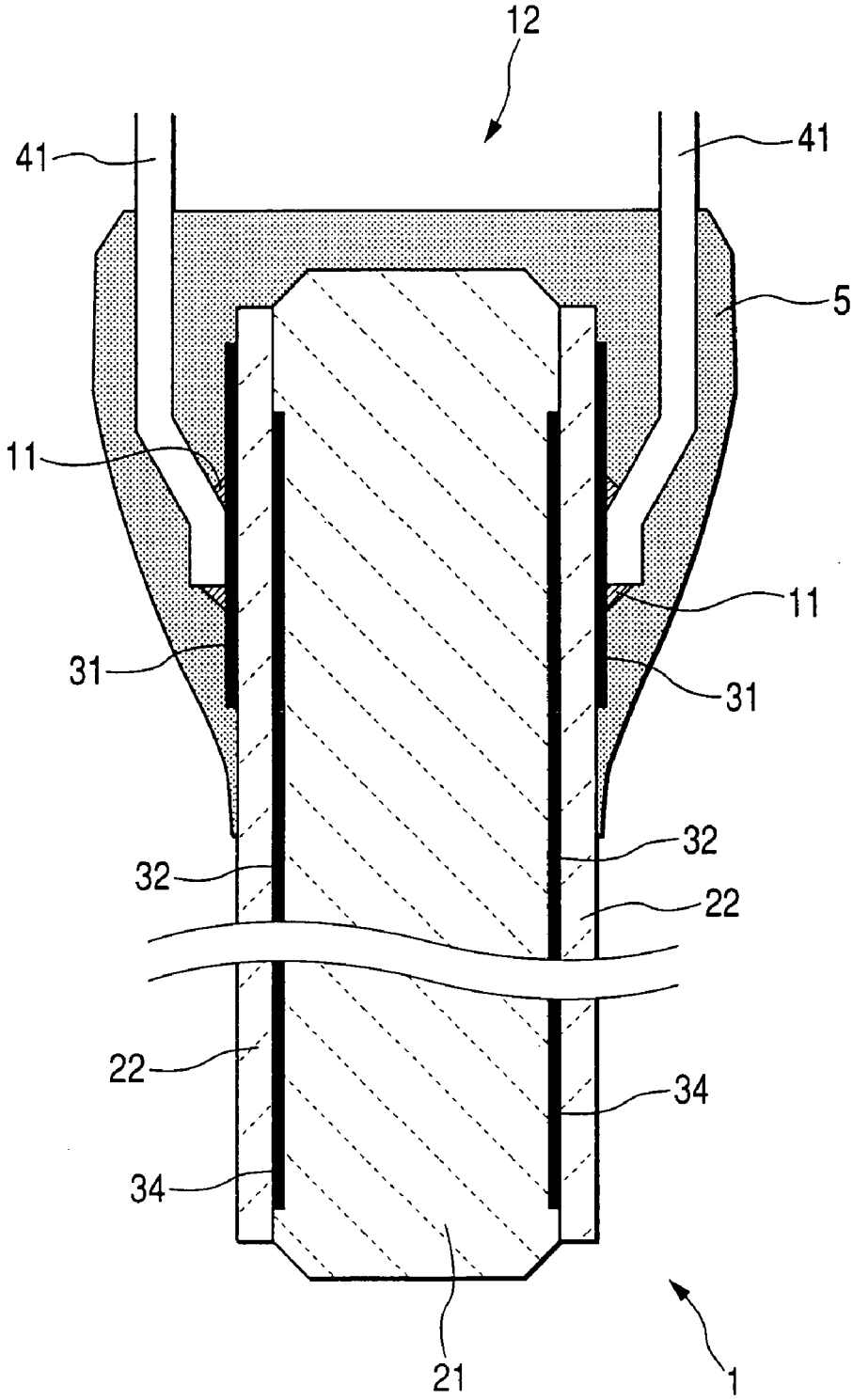
FIG. 3 is a partially longitudinal sectional view, as taken along the line B-B of FIG. 2, which shows a sealing structure of joints between leads and terminals of the ceramic heater of FIG. 1.
Figure 4:
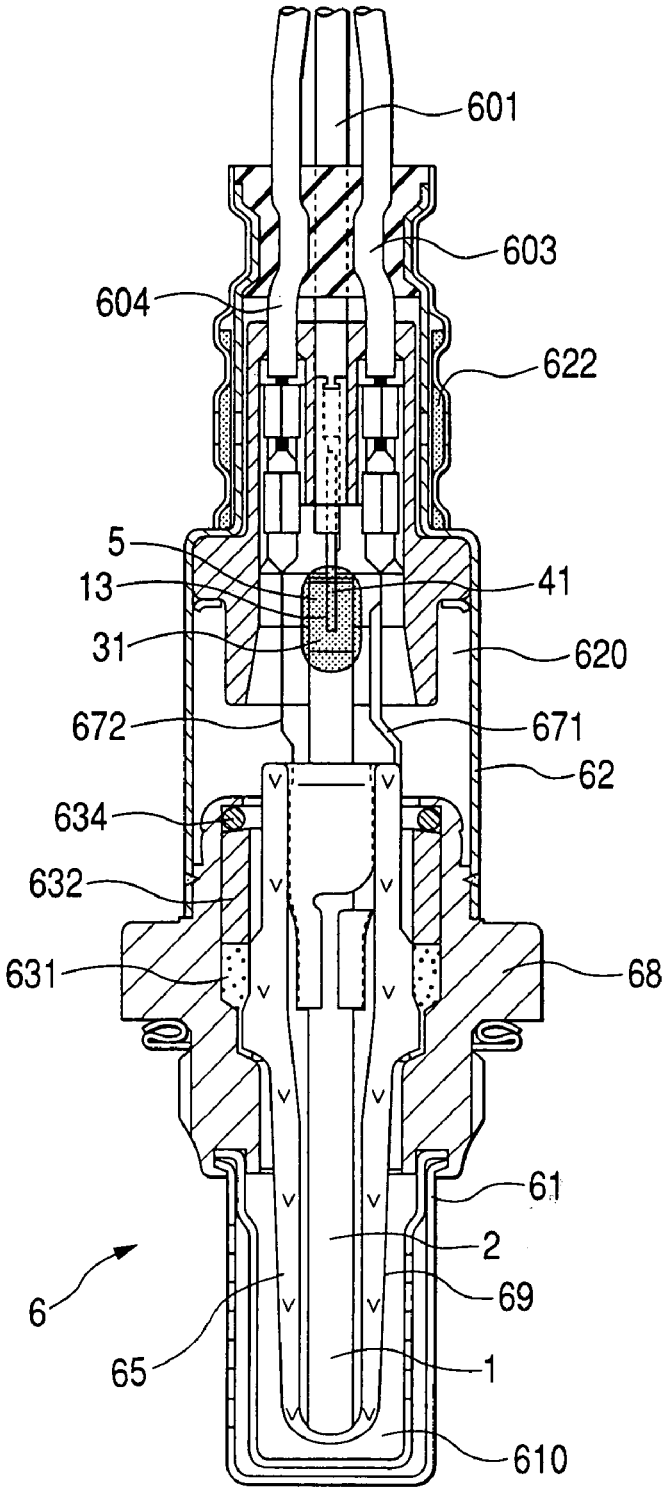
FIG. 4 is a longitudinal sectional view which shows a gas sensor equipped with the sensor element of FIGS. 1 to 3.

Referring to the drawings, wherein like reference numbers refer to like parts in several views, particularly to FIGS. 1, 2, and 3, there is shown a ceramic heater 1 according to the first embodiment of the invention which may be built in a gas sensor, as illustrated in FIG. 4, designed to measure the concentration of a given component of exhaust emissions of automotive engines.

The ceramic heater 1 is essentially made up of a bar-shaped ceramic heater body 2 and a pair of heater conductors 3 equipped with terminals 31 attached to an end portion of the heater body 2. To the terminals 31, leads 41 are connected through joints 13 for supplying electrical power to the heater conductors 3. The joints 13 are covered with a glass seal 5.

The glass seal 5, as can be seen from FIGS. 1 to 3, covers the whole of the terminals 31. The glass seal 5 has a coefficient of thermal expansion lying in a range of $\pm 15\times 10^{-7}/°$ C. and preferably $\pm 10\times 10^{-7}/°$ C. of that of the heater body 2. For example, when the heater body 2 is made of alumina ($Al_2O_3$) and has a coefficient of thermal expansion of $60\times 10^{-7}/°$ C., the glass seal 5 preferably has a coefficient of thermal expansion of $45\text{-}75\times 10^{-7}/°$ C. and more preferably $50\text{-}70\times 10^{-7}/°$ C. Alternatively, when the heater body 2 is made of silicon nitride ($Si_3N_4$) and has a coefficient of thermal expansion of $25\times 10^{-7}/°$ C., the glass seal 5 preferably has a coefficient of thermal expansion of $10\text{-}40\times 10^{-7}/°$ C. and more preferably $15\text{-}35\times 10^{-7}/°$ C.

The glass seal 5 has a glass transition temperature of 400° C. or more and a welding temperature of 900° C. or less.

Each of the leads 41 is, as clearly illustrated in FIG. 2, soldered with a brazing metal 11 to one of the terminals 31. The leads 41 may be jointed to the terminals 31 in any other welding manner. The glass seal 5 also covers the whole of the brazing metal 11, thereby sealing a joint interface 111 between the brazing metal 11 and the lead 41 and a joint interface between the brazing metal 11 and the terminal 31.

The heater body 2 is of a substantially cylindrical shape and made up of a ceramic core bar 21 and a ceramic sheet 22 wrapped round the periphery of the core bar 21. The ceramic sheet 22 has formed therein the heater conductors 3 each of which, as shown in FIGS. 2 and 3, consists of a heating element 34, the terminal 31, an inner lead 32, and a conductive through hole 33. The inner lead 32 is electrically connected to the terminal 31 through the hole 33 and also to the heating element 34. The heating element 34 and the inner lead 32 are formed on an inner surface of the ceramic sheet 22, while the terminal 31 is formed on an outer surface of the ceramic sheet 22.

The terminals 31 are diametrically opposed to each other on an end portion 12 of the circumference of the heater body 2. The leads 41 are, as described above, joined to the terminals 31 through the brazing metals 11, respectively. The glass seal 5 is formed around the whole of the circumference of the end portion 12 to surround the joints 13 of the terminals 13 and the leads 41 hermetically.

The sealing of the joints 13 with the glass seal 5 is achieved by applying a glass paste over the joints 13 or putting a prebaked glass in a mold and welding it to the joints 13 at, for example, 750° C. within a tunnel furnace or a batch furnace. The sealing may alternatively be made by placing the end portion 12 of the ceramic heater 1 on which the joints 13 are formed within a mold, leading a sealing material into the mold, cooling the mold to solidify to the sealing material, and removing the end portion 12 from the mold.

The ceramic heater 1, as described above, may be built in a gas sensor such as the one illustrated in FIG. 4.

The gas sensor 6 of FIG. 4 includes a hollow cylindrical housing 68, a cup-shaped gas sensor element 65, a protective cover assembly 61, and an air cover 62. The gas sensor element 65 is retained inside the housing 68. The protective cover assembly 61 is joined to a top end of the housing 68. The air cover 62 is welded to a base end of the housing 68 in alignment with the protective cover assembly 61.

The protective cover assembly 61 has defined therein a gas chamber 610 into which gases such as exhaust emissions from an automotive engine are admitted. The gas sensor element 65 is exposed to the gas chamber 610 and works to produce a signal as a function of concentration of oxygen contained in the gasses. The air cover 62 has defined therein an air chamber 620 into which the atmospheric air is admitted. The air chamber 620 leads to inside the gas sensor element 65.

A powder seal 631 and an insulator 632 are disposed between an inner wall of the housing 68 and an outer wall of the gas sensor element 65 to form a hermetical seal therebetween. A ring gasket 634 is disposed on the end of the insulator 632. The annular end of the housing 68 is crimped inwardly to urge the ring gasket 634 into constant abutment with the insulator 632 to enhance the degree of sealing between the housing 68 and the gas sensor element 65.

The gas sensor element 65 consists of a bottomed hollow cylindrical solid electrolyte body 69 and an inner and an outer electrode (not shown) affixed to an inner and an outer surface of the solid electrolyte body 69. The ceramic heater 1 is disposed inside the solid electrolyte body 69.

Terminals 671 and 672 are affixed to the gas sensor element 65 and electrically lead to the inner and outer electrodes. The terminals 671 and 672 are also jointed to external leads 603 and 604.

The leads 41 of the ceramic heater 1 are connected to external leads 601 (only one is shown for the brevity of illustration), respectively.

The ceramic heater 1 is, as described above, covered hermetically at the joints 13 of the terminals 31 and the leads 41 with the glass seal 5, thus avoiding directly contact of the joints 13 with moisture or substances contained in the exhaust emissions of the engine which give rise to corrosion of the joints 13.

The operation of the gas sensor 6 where it is installed in an exhaust pipe of an automotive engine will be described below.

The fresh air enters inside the air cover 62 through a water-repellent filter 622.

Upon start of the engine, the gas sensor 6 starts to measure the concentration of oxygen contained in exhaust gasses from the engine. The exhaust gasses enters the protective cover assembly 61. The part of the exhaust gasses may leak through the powder seal 631 and the insulator 632 and reach the joints 13 of the terminals 31 and the leads 41 of the ceramic heater 1. The joints 13 are, however, covered completely by the glass seal 5, thus avoiding direct contact thereof with the exhaust gasses which can give rise to the corrosion of the joints 13.

The glass seal 5 also serves to avoid any defects of the ceramic heater 1 arising from corrosion-causing chemicals adhered to the joints 13 during production of the ceramic heater 1. For example, in the plating treatment the ceramic heater 1 usually undergoes during production processes, chlorine may stick to and stay on the joints 13. If the water is mixed with the chlorine, it will produce electrolyte, which may result in corrosion of the joints 13. In the worst case, it cause the leads 41 to be separated from the terminals 31. The glass seal 5 serves to avoid such a problem and ensures the durability of the ceramic heater 1.

The glass seal 5, as described above, covers the whole of the terminals 31, thus enhancing the avoidance of corrosion of the joints 13 to improve the durability of the ceramic heater 1.

The glass seal 5 offers the resistance to high temperatures in the nature of material thereof, thus ensuring the joint strength of the terminals 31 and the leads 41 in high-temperature environments.

The glass seal 5, as described above, has a coefficient of thermal expansion lying in a range of $\pm 15\times 10^{-7}/°$ C. of that of the heater body 2, thereby reducing a difference in thermal expansion between the heater body 2 and the seal 5 during usage of the ceramic heater 1 to minimize cracks in the seal 5.

The glass seal 5 has a glass transition temperature of 400° C. or more and a welding temperature of 900° C. or less, thereby ensuring the durability thereof and air- and liquid-tight sealing of the joints 13 of the terminals 31 and the leads 41 without any adverse impact thereon. Specifically, the melting point of the brazing metals 11 is approximately 950 to 970° C. Thus, as long as the welding temperature of the seal 5 is 900° C. or less, the brazing metals 11 will not be fused during welding of the seal 5 to the heater body 2. A maximum operating temperature of the gas sensor 6 is usually 400° C. Therefore, as long as the glass transition temperature of the seal 5 is 400° C. or more, it will keep the seal 5 solid during usage of the gas sensor 6.

Figure 5:
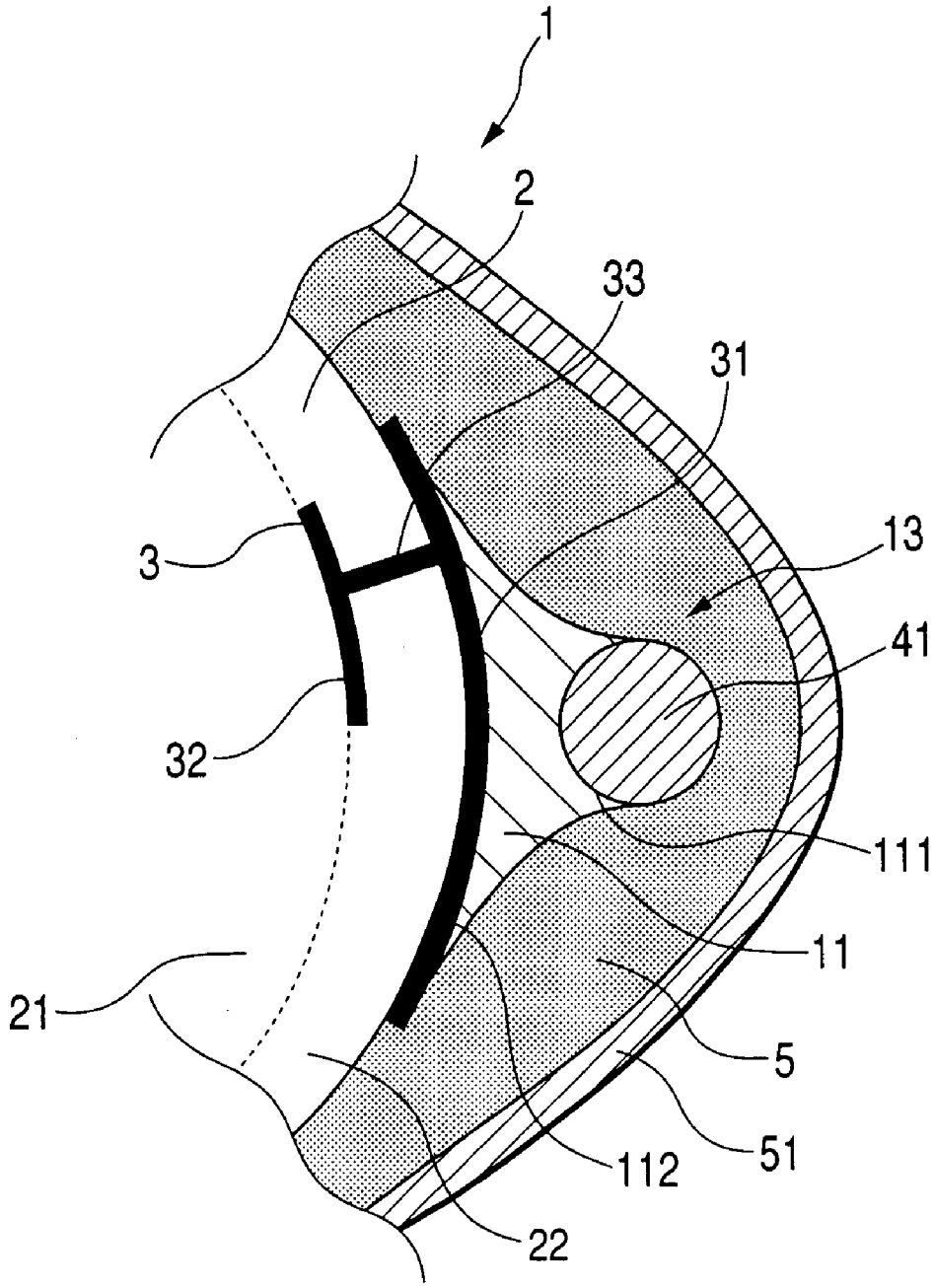
FIG. 5 is a partially traverse sectional view which shows a sealing structure of joints between leads and terminals of a ceramic heater according to the second embodiment of the invention.
Figure 6:
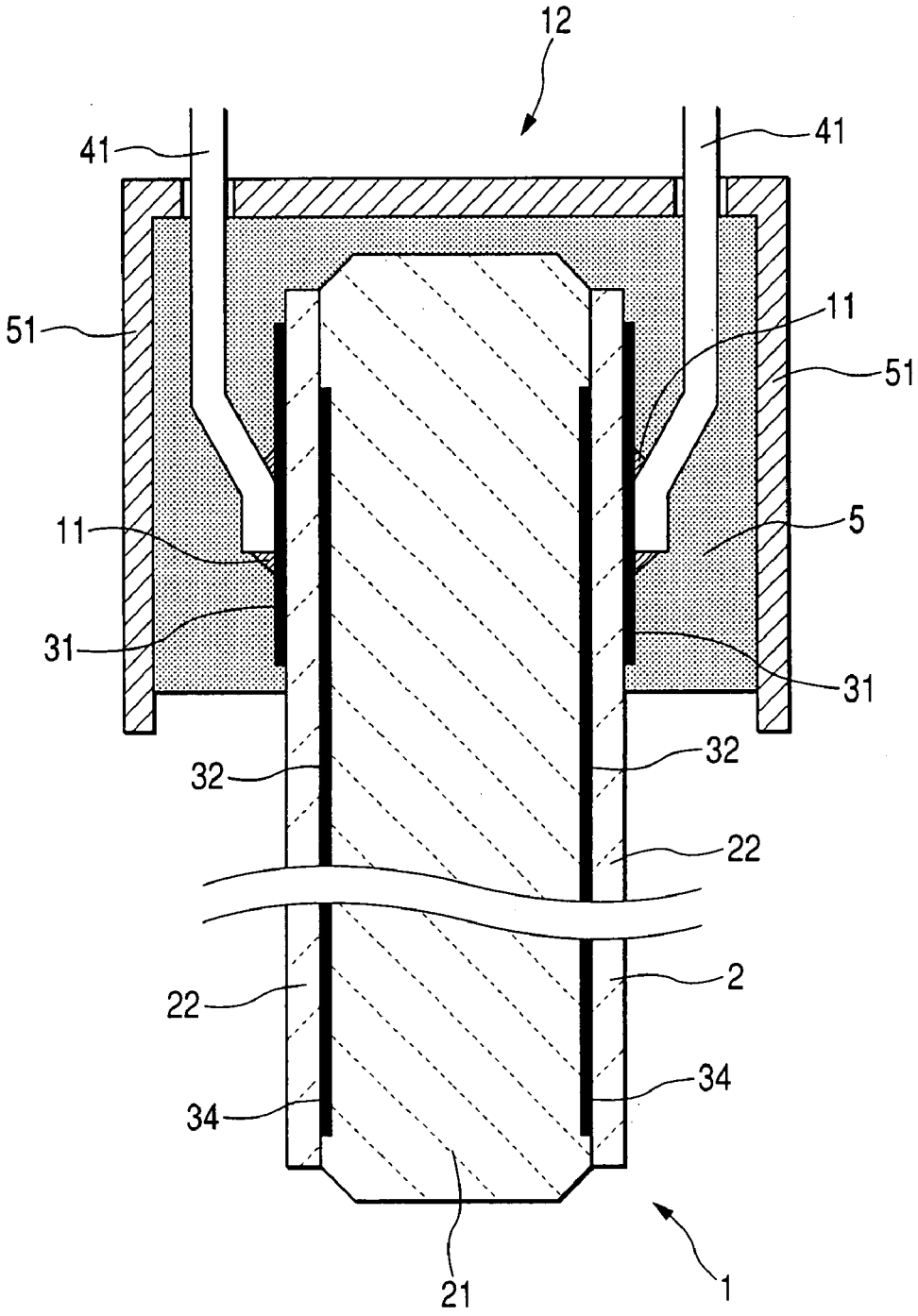
FIG. 6 is a partially longitudinal sectional view which shows a sealing structure of joints between leads and terminals of a ceramic heater of the second embodiment.
Figure 7:
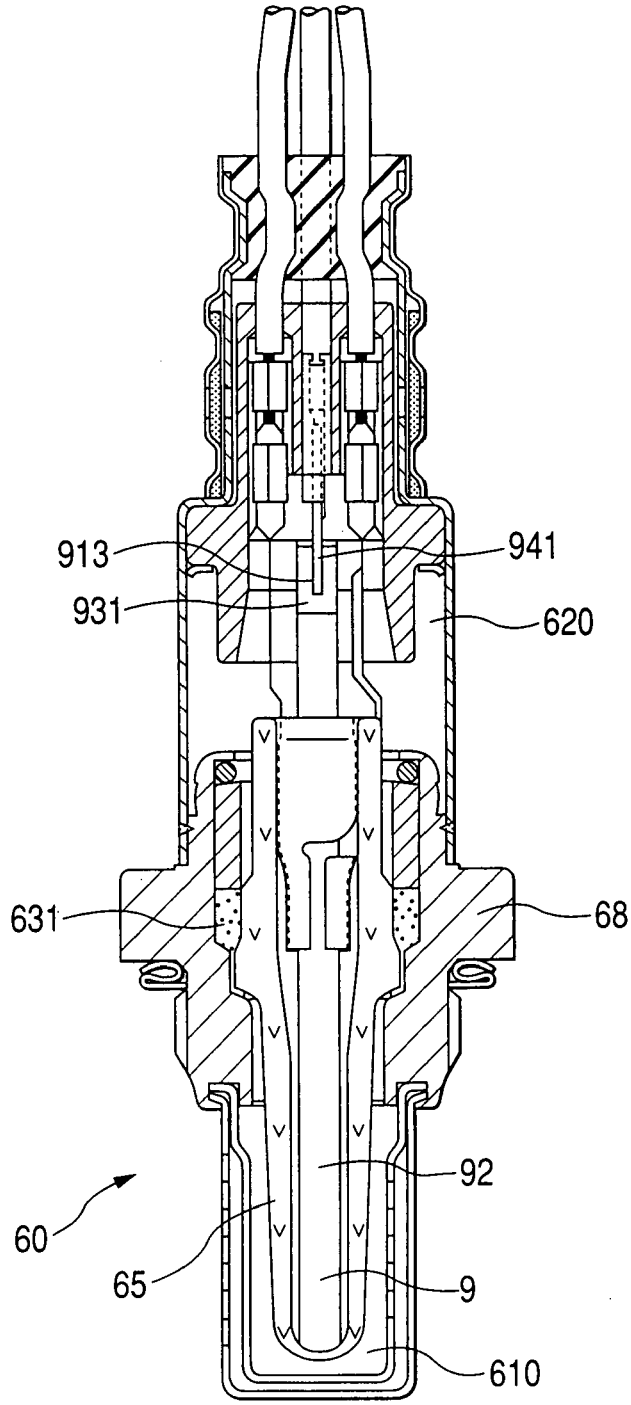
FIG. 7 (PRIOR ART)
FIG. 7 is a longitudinal sectional view which shows a gas sensor equipped with a conventional ceramic heater.
Figure 8:
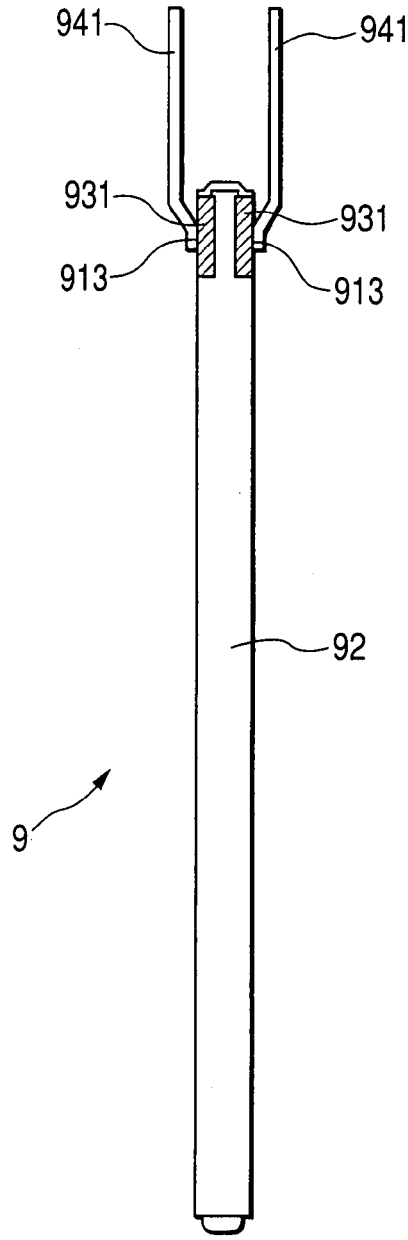
FIG. 8 (PRIOR ART)
FIG. 8 is a plan view which shows the ceramic heater built in the gas sensor of FIG. 7.
Figure 9:
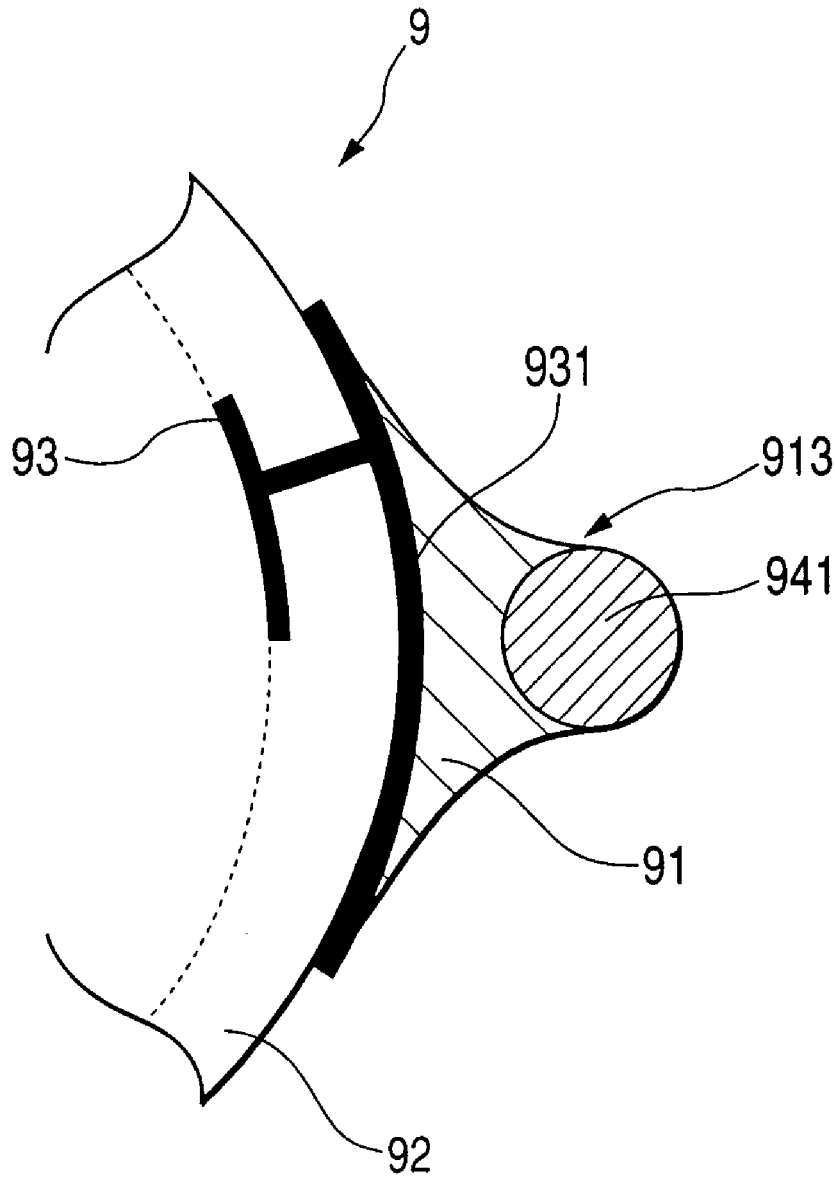
FIG. 9 (PRIOR ART)
FIG. 9 is a partially traverse sectional view which shows a joint between a terminal and a lead of the ceramic heater of FIG. 8.

FIGS. 5 and 6 show the ceramic heater 1 according to the second embodiment of the invention which is different from the one of FIGS. 1 to 3 in that the glass seal 5 is covered with a holder 51 to keep the profile thereof in a desired shape.

Specifically, the holder 51 is, as clearly illustrated in FIG. 6, of a cap-shape and fitted on the whole of the seal 5. In other words, the holder 51 is filled with the seal 5 to cover the joints 13 of the terminals 31 and the leads 41 hermetically. The holder 51 is may be made of alumina or mullite. Other arrangements are identical with those in the first embodiment, and explanation thereof in detail will be omitted here.

The ceramic heater 1 of the third embodiment will be described below.

The ceramic heater 1 has the leads 41 made of 42 alloy or kovar. The 42 alloy is an alloy of Ni and Fe and has a coefficient of thermal expansion of 45 to $65\times 10^{-7}/°$ C. The kovar is an alloy of Ni, CO, and Fe and has a coefficient of thermal expansion of 45 to $65\times 10^{-7}/°$ C.

The heater body 2 is made of alumina. The seal 5 is made of glass. Other arrangements are identical with those in the first embodiment.

The coefficient of thermal expansion of the glass seal 5 is within a range of $\pm 15\times 10^{-7}/°$ C. of that of the leads 41 and may also be selected to be within a range of $\pm 10\times 10^{-7}/°$ C. closer to that of the leads 41. Specifically, in a case where the coefficient of thermal expansion of the heater body 2 made of alumina is, as described above, $60\times 10^{-7}/°$ C., the glass seal 5 preferably has a coefficient of thermal expansion of $45\text{-}75\times 10^{-7}/°$ C. and more preferably of $50\text{-}70\times 10^{-7}/°$ C. In this case, the coefficient of thermal expansion of the leads 41 may be approximated to that of the glass seal 5 by making the leads 41 of 42 alloy in order to reduce a difference in thermal expansion between the leads 41 and the glass seal 5 during usage of the ceramic heater 1 to minimize cracks in the interface of the seal 5 with the leads 41.

In a case where the ceramic heater 1 is built in a gas sensor to be used at a lower operating temperature of 300 to 350° C., the joints 13 of the terminals 31 and the leads 41 may alternatively be covered with resin such as polyimide resin instead of the glass seal 5.

The seal 5 needs not necessarily cover the whole of the terminals 31 of the heater conductors 3 and may cover at least the joints 13 between the terminals 31 and the leads 41. In the first embodiment, the seal 5 may cover at least the joint interface 111 between the brazing metals 11 and the leads 41.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A gas sensor comprising:

a cup-shaped sensor element working to produce a signal as a function of a concentration of gas to be measured;

a housing within which said sensor element is retained;

a gas cover joined to said housing to define a gas chamber into which the gas is admitted and to which said sensor element is exposed;

an air cover joined to said housing to define an air chamber into which air is admitted through a water-repellent filter as a reference gas and which leads inside said sensor element; and a ceramic heater disposed inside said sensor element, said ceramic heater including:

a ceramic body;

a pair of electrical conductors formed on said ceramic body, each of said conductors is equipped with a terminal;

leads joined to the terminals of said conductors for supplying electrical power to said conductors; and a seal covering joints between said leads and the terminals of said conductors hermetically, said seal being disposed inside the air chamber.

2. A gas sensor as set forth in claim 1, wherein said seal covers a whole of the terminals of said conductors.

3. A gas sensor as set forth in claim 1, wherein said seal is made of glass.

4. A gas sensor as set forth in claim 3, wherein said seal has a coefficient of thermal expansion within a range of $\pm 15\times10^{-7}/°$ C. of that of said heater body.

5. A gas sensor as set forth in claim 3, wherein said seal has a glass transition temperature of 400° C. or more and a welding temperature of 900° C. or less.

6. A gas sensor as set forth in claim 3, wherein said seal has a coefficient of thermal expansion within a range of $\pm 15\times10^{-7}/°$ C. of that of said leads.

7. A gas sensor as set forth in claim 3, wherein said leads are made of one of 42 alloy and kovar.

8. A gas sensor as set forth in claim 1, further comprising a holder retaining therein said seal to keep a configuration of said seal in a desired shape.

9. A gas sensor as set forth in claim 1, wherein said air cover defines an air passage which leads to an air inlet through the water-repellent filter and to inside said sensor element through the air chamber, and wherein the seal of said ceramic heater is exposed to the air passage.

* * * * *